US007832574B1

(12) United States Patent
Sexton

(10) Patent No.: US 7,832,574 B1
(45) Date of Patent: Nov. 16, 2010

(54) PORTABLE COLLAPSIBLE GARMENT SUPPORT RACK APPARATUS

(76) Inventor: Lamar Sexton, 708 Dahlonega Rd., Cumming, GA (US) 30040

( * ) Notice: Subject to any disclaimer, the term of this patent is extended or adjusted under 35 U.S.C. 154(b) by 0 days.

(21) Appl. No.: 12/710,141

(22) Filed: Feb. 22, 2010

(51) Int. Cl.
*A47B 47/00* (2006.01)

(52) U.S. Cl. ..... 211/195; 248/150

(58) Field of Classification Search ..... 211/200, 211/195, 204, 206, 85.24, 175, 202, 189; 248/150, 136, 166
See application file for complete search history.

(56) References Cited

U.S. PATENT DOCUMENTS

| | | | | | |
|---|---|---|---|---|---|
| 989,433 | A * | 4/1911 | Schmitt | 211/195 |
| 3,338,422 | A * | 8/1967 | Hickok | 211/70.5 |
| 3,661,270 | A | 5/1972 | Lucci et al. | |
| 3,722,702 | A * | 3/1973 | Marker, Jr. | 211/204 |
| 4,523,768 | A * | 6/1985 | Dlubala | 280/42 |
| 4,917,249 | A | 4/1990 | King | |
| 5,044,507 | A | 9/1991 | Shulyak | |
| 5,213,221 | A * | 5/1993 | Raye, Sr. | 211/195 |
| 5,617,962 | A * | 4/1997 | Chen | 211/206 |
| 5,934,524 | A | 8/1999 | Gray | |
| 6,131,749 | A * | 10/2000 | Crockett et al. | 211/195 |
| 2002/0121493 | A1 * | 9/2002 | Wang | 211/195 |
| 2007/0012638 | A1 | 1/2007 | Van Eijk | |
| 2009/0184073 | A1 * | 7/2009 | Lu | 211/85.3 |

* cited by examiner

*Primary Examiner*—Jennifer E. Novosad
(74) *Attorney, Agent, or Firm*—Crossley Patent Law; Mark A. Crossley

(57) ABSTRACT

The portable collapsible garment support rack apparatus provides several desirable features. First, the apparatus can be marginally or even completely disassembled to aid in portability and transport, as well as compact storage. Disassembly and reassembly are rapid and basic. The apparatus further provides adjustable height legs, and adjustable length by way of the expansion insert fitted within the two upper tubes. Each end of the apparatus, when in the expanded state, forms an a-frame type construction, with each end having a pair of braces extended downwardly and angularly to be braced against the first and second legs of each end, thereby bracing the a-frame shape. A cross brace is also provided at each end to pivotally and removably fasten the first leg to the second leg. Each of the braces is flat-ended for best mating with the related legs and with the upper tubes.

6 Claims, 5 Drawing Sheets

PORTABLE COLLAPSIBLE GARMENT SUPPORT RACK APPARATUS

BACKGROUND OF THE INVENTION

The need for garment racks is well understood, especially portable garment racks that removably receive clothes hangers. College students, homeowners, apartment dwellers, and a host of other users can well testify to the usefulness of added hanging clothes storage spaces. The present apparatus provides a unique, portable garment support rack that is collapsible and height and length adjustable.

FIELD OF THE INVENTION

The portable collapsible garment support rack apparatus relates to garment racks and more especially to a portable height and length adjustable garment support rack apparatus that is collapsible.

SUMMARY OF THE INVENTION

The general purpose of the portable collapsible garment support rack apparatus, described subsequently in greater detail, is to provide a portable collapsible garment support rack apparatus which has many novel features that result in an improved portable collapsible garment support rack apparatus which is not anticipated, rendered obvious, suggested, or even implied by prior art, either alone or in combination thereof.

To attain this, the portable collapsible garment support rack apparatus provides several desirable features. First, the apparatus can be marginally or even completely disassembled to aid in portability and transport, as well as compact storage. Disassembly and reassembly are rapid and basic. The apparatus further provides adjustable height legs, and adjustable length by way of the expansion insert fitted within the two upper tubes. Each end of the apparatus, when in the expanded state, forms an a-frame type construction, with each end having a pair of braces extended downwardly and angularly to be braced against the first and second legs of each end. A cross brace is also provided at each end to pivotally and removably fasten the first leg to the second leg. The bracing of the apparatus can be but is not limited to hollow tubes, thereby providing light weight as well as strength. The bracing of the apparatus can be but is not limited to hollow tubes, thereby providing light weight as well as strength.

Fasteners that secure the various components of the apparatus are provided in an myriad of styles.

Thus has been broadly outlined the more important features of the improved portable collapsible garment support rack apparatus so that the detailed description thereof that follows may be better understood and in order that the present contribution to the art may be better appreciated.

An object of the portable collapsible garment support rack apparatus is to be easily collapsible and expandable.

Another object of the portable collapsible garment support rack apparatus is to be highly portable.

A further object of the portable collapsible garment support rack apparatus is to be height adjustable.

An added object of the portable collapsible garment support rack apparatus is to be length adjustable.

These together with additional objects, features and advantages of the improved portable collapsible garment support rack apparatus will be readily apparent to those of ordinary skill in the art upon reading the following detailed description of presently preferred, but nonetheless illustrative, embodiments of the improved portable collapsible garment support rack apparatus when taken in conjunction with the accompanying drawings.

In this respect, before explaining the current embodiments of the improved portable collapsible garment support rack apparatus in detail, it is to be understood that the portable collapsible garment support rack apparatus is not limited in its application to the details of construction and arrangements of the components set forth in the following description or illustration.

Those skilled in the art will appreciate that the concept of this disclosure may be readily utilized as a basis for the design of other structures, methods, and systems for carrying out the several purposes of the improved portable collapsible garment support rack apparatus. It is therefore important that the claims be regarded as including such equivalent constructions insofar as they do not depart from the spirit and scope of the portable collapsible garment support rack apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the portable collapsible garment support rack apparatus generally designated by the reference number 10 will be described.

Figure 1:
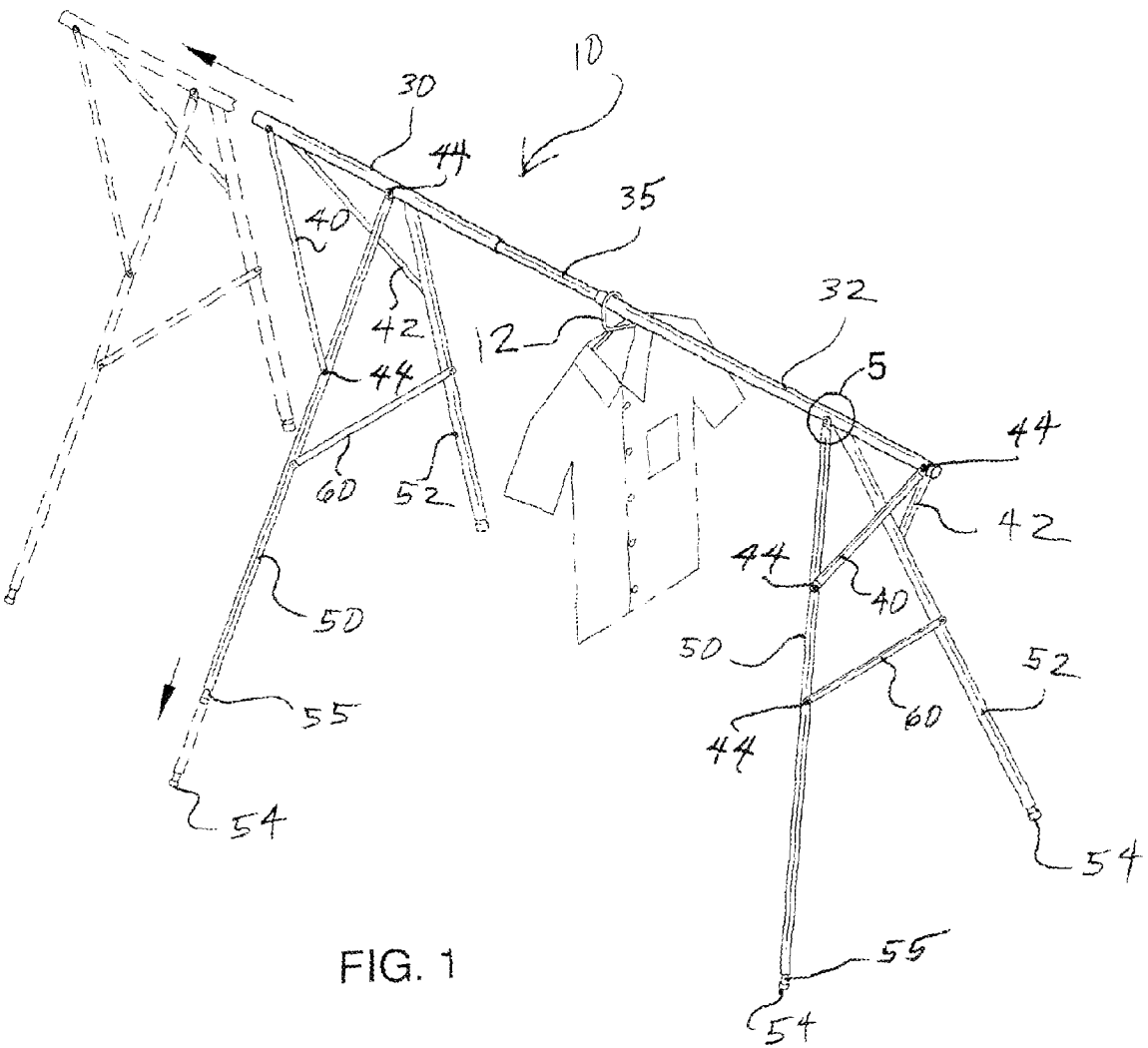
FIG. 1 is a perspective view of the expanded apparatus.
Figure 2:
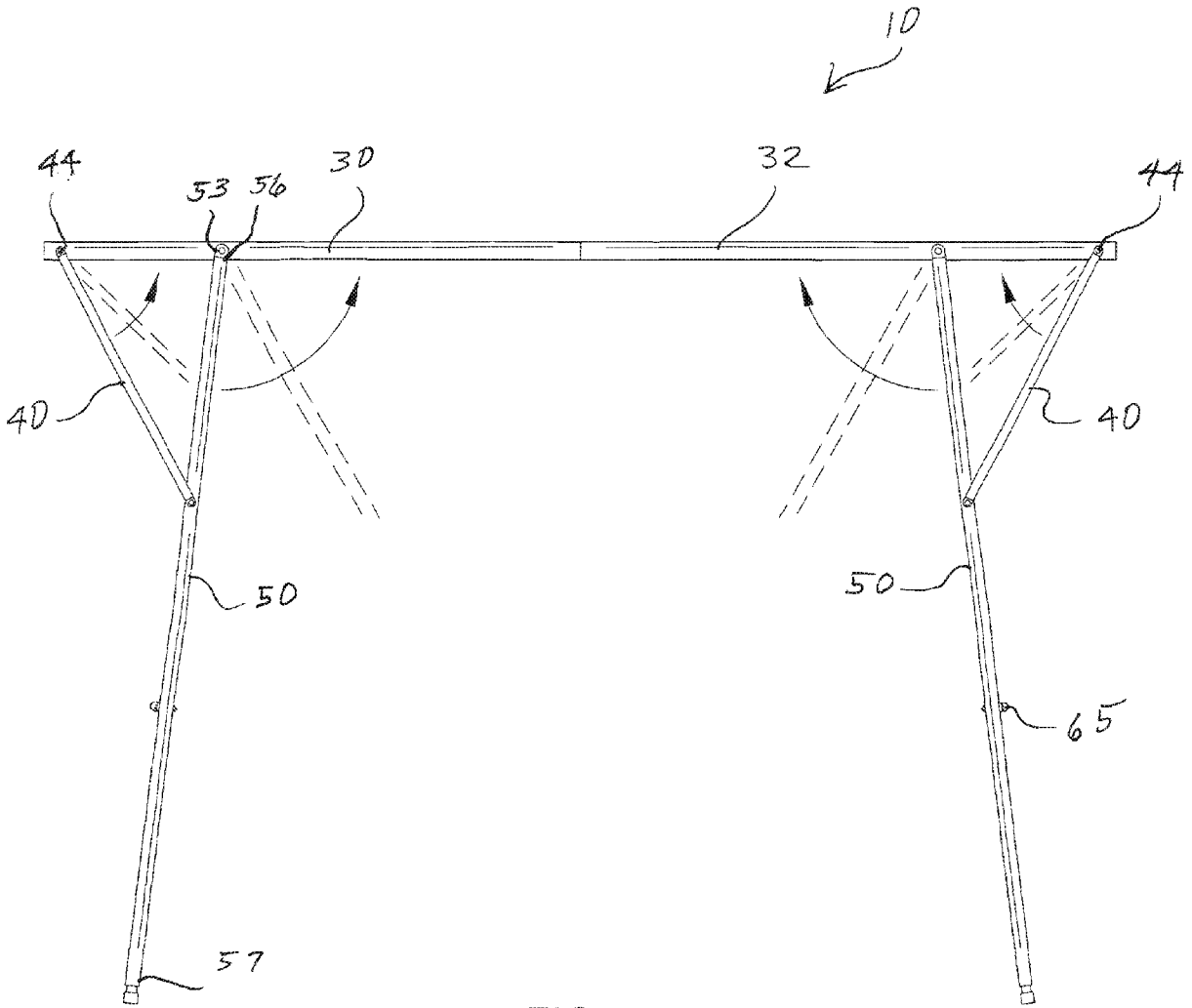
FIG. 2 is a front elevation view of the expanded apparatus.

Referring to FIG. 1, the apparatus 10 is partially comprised of a pair of identical upper tubes comprising the first upper tube 30 and the second upper tube 32. Each upper tube further comprises a horizontally disposed midline. Hanger 12 and the like are supported by the apparatus 10.

Referring to FIG. 2 and again to FIG. 1, the expansion insert 35 removably, slideably, and medially connects the upper tubes such that the apparatus 10 is length adjustable. A pair of legs is disposed substantially laterally on each of the upper tubes. Each pair of legs comprises a first leg 50 and a second leg 52. Each leg has a leg top 56 spaced apart from a leg bottom 57. A flat section 53 is disposed at each leg top 56. The flat section 53 of one first leg 50 is pivotally connected to one side of the first upper tube 30 midline. The flat section 53 of one second leg 52 is pivotally connected to an opposite side of the midline of the first upper tube 30. The flat section 53 of another first leg 50 is pivotally connected to one side of the second upper tube 32 midline. The flat section 53 of the second leg 52 is pivotally connected to an opposite side of the midline of the second upper tube 32. The leg flat sections 53 of the first upper tube 30 are connected by a single fastener 44. The leg flat sections 53 of the second upper tube 32 are connected by a single fastener 44.

Figure 4:
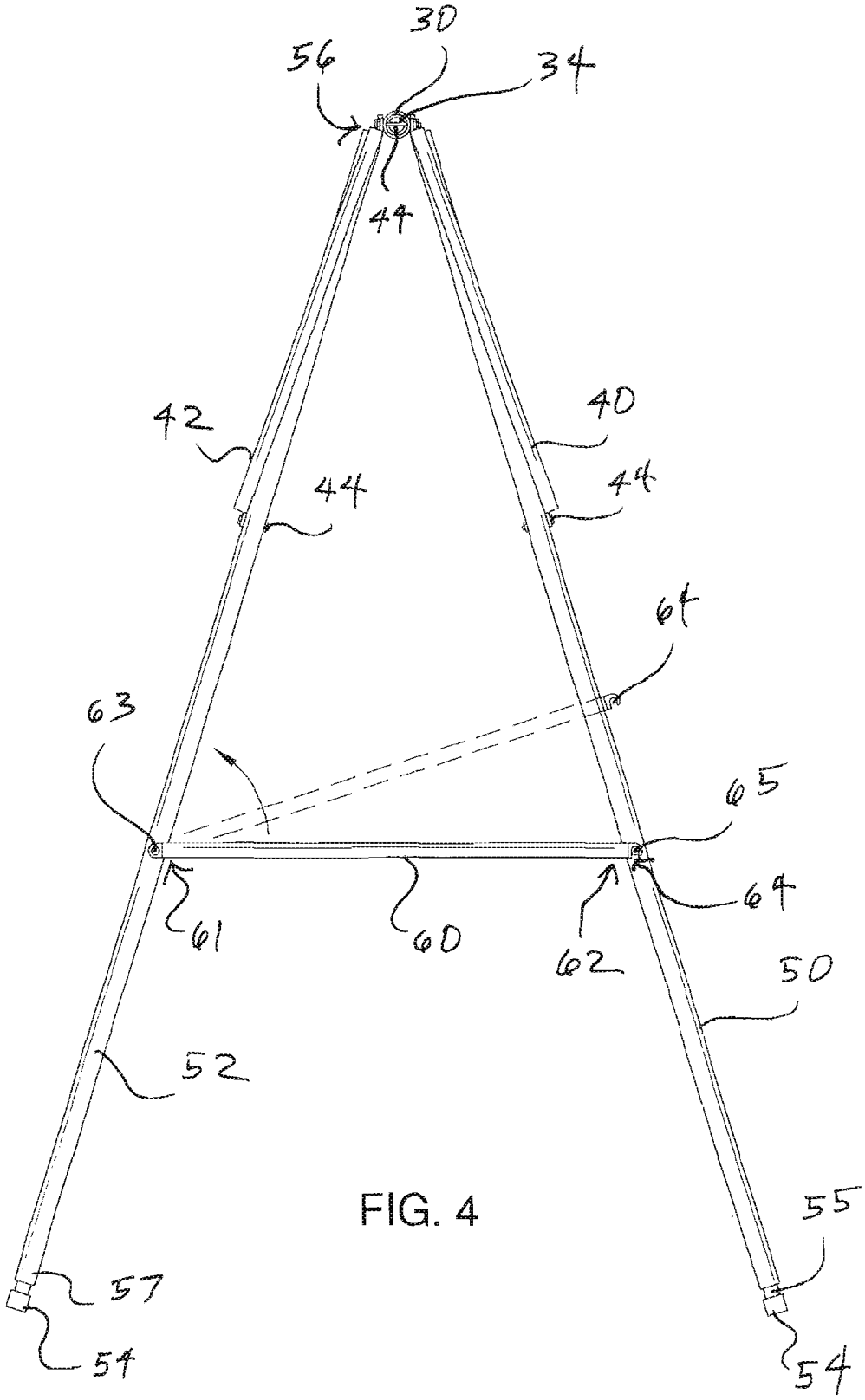
FIG. 4 is an end elevation view of the expanded apparatus.
Figure 5:
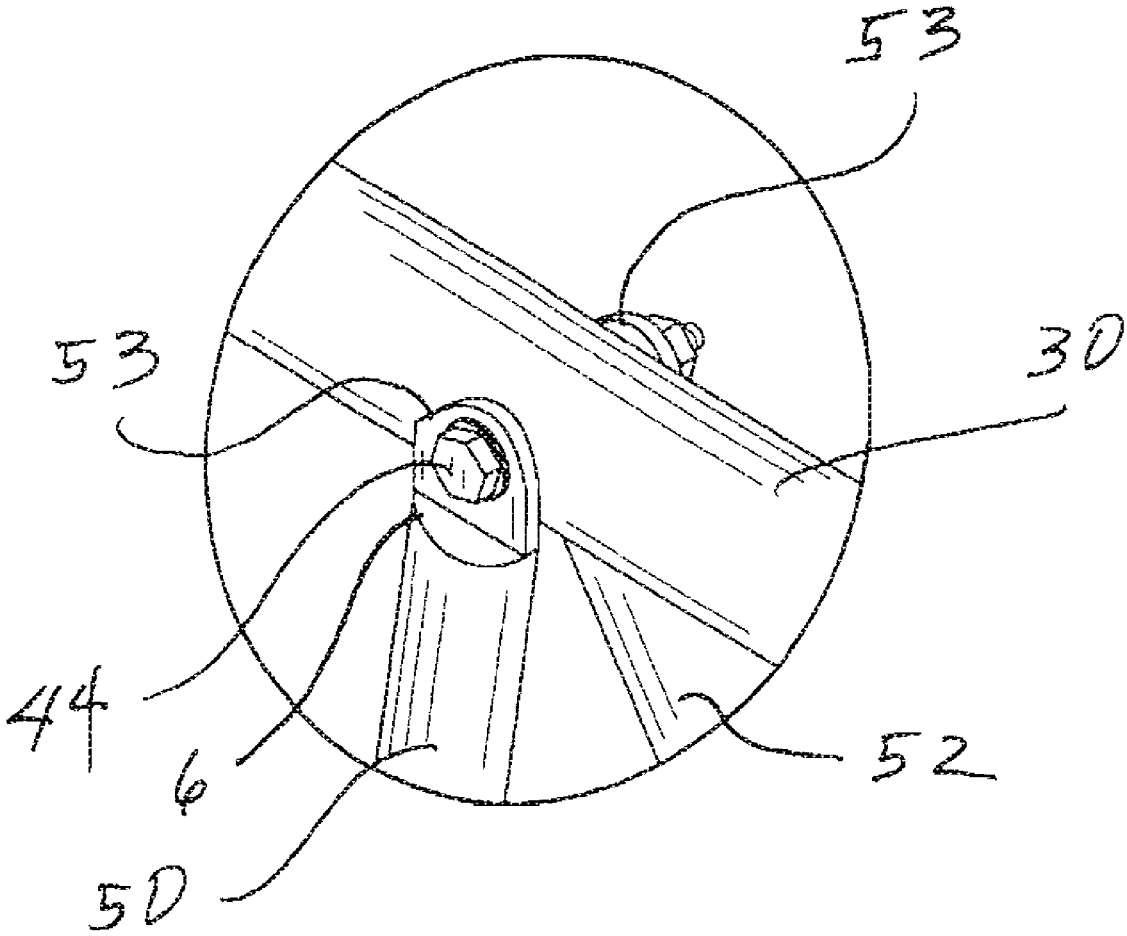
FIG. 5 is a perspective view of the pivotal connection between the first and second legs and the first upper tube.

Referring to FIGS. 4 and 5, fasteners 44 may be bolts, various machine screws with wing nuts, pins, clevis pins, or any other of a host of appropriate fasteners 44 known in the art.

Figure 3:
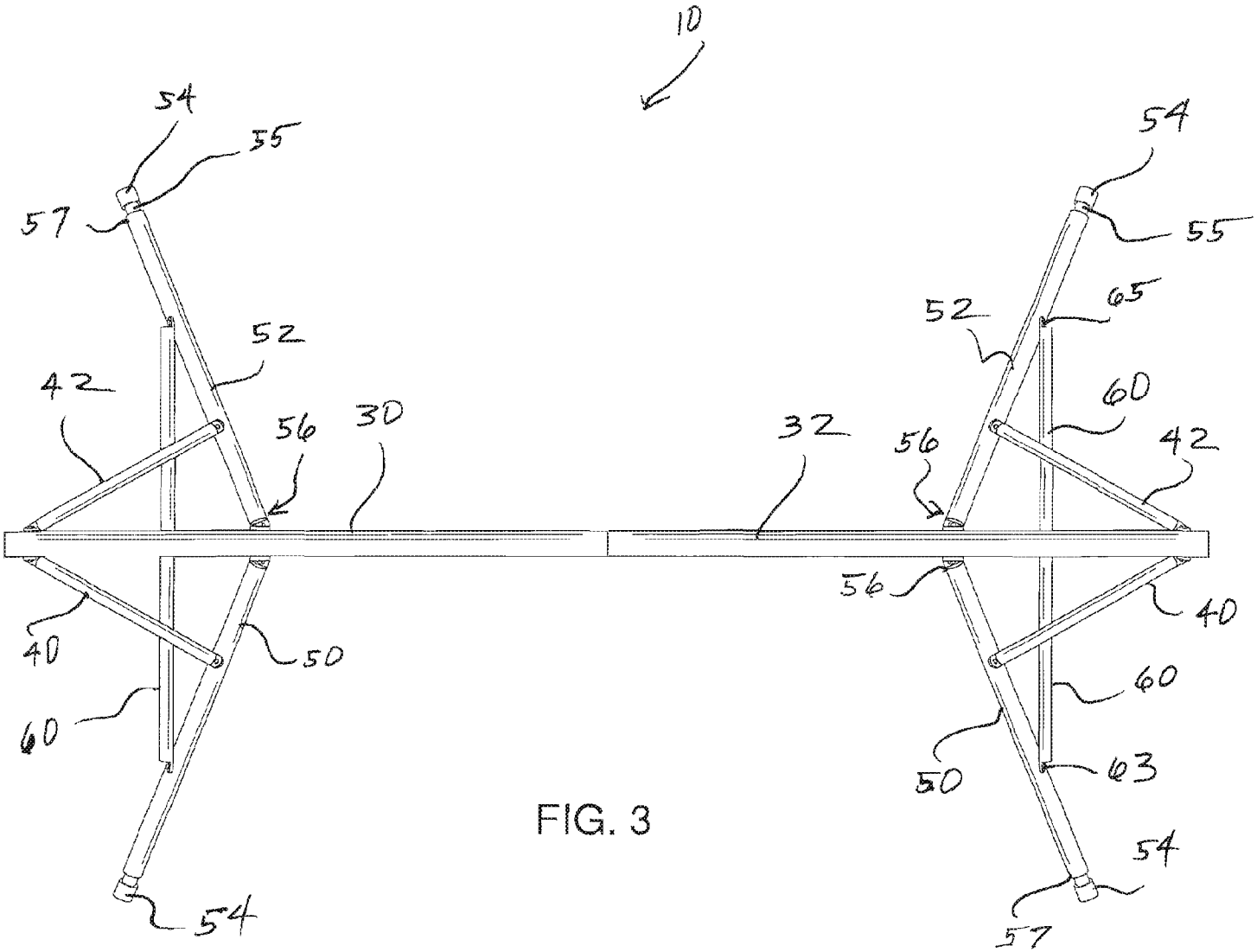
FIG. 3 is a top plan view of the expanded apparatus.

Referring to FIGS. 3 and 4, a pair of support braces pivotally connects each upper tube to each of one of the pair of legs. Each pair of support braces comprises a first support brace 40 and a second support brace 42. One of the first support braces 40 is pivotally connected laterally to the first upper tube 30 midline. The first support brace 40 further pivotally connects to one first leg 50 between the leg top 56 and the leg bottom 57. One second support brace 42 is pivotally connected laterally to the first upper tube 30 midline. The second support brace 42 further pivotally connects to one second leg 52 between the leg top 56 and the leg bottom 57. One of the first support braces 40 pivotally connects laterally to the second upper tube 32 midline. The first support brace 40 is further pivotally connected to one first leg 50 between the leg top 56 and the leg bottom 57. One of the second support braces 42 is pivotally connected laterally to the second upper tube 32 midline. The second support brace 42 further pivotally connects to one second leg 52 between the leg top 56 and the leg bottom 57. The support braces are connected to the upper tubes and the legs by fasteners 44.

Referring again to FIGS. 3 and 4, a pair of cross braces 60 is provided. Each cross brace 60 has a brace first end 61 spaced apart from a brace second end 62. The brace first end 61 is pivotally connected to the first leg 50 of the first upper tube 30 by a fastener 44 at the brace pivot 63.

The brace second end 62 of the cross brace 60 is further connected to the second leg 52 of the first upper tube 30 by a brace notch 64 of the cross brace 60 removably fitted over a headed pin 65 of the second leg 52. The cross brace 60 is connected below the support brace and leg connections. As with the components related to the first upper tube 30, those of the second upper tube 32 comprise an identical cross brace 60 having a brace first end 61 spaced apart from a brace second end 62. The brace first end 61 is pivotally connected to the first leg 50 of the second upper tube 32 by a fastener 44 to form a brace pivot 63. The brace second end 62 is further connected to the second leg 52 of the second upper tube 32 by a brace notch 64 of the cross brace 60 removably fitted over a headed pin 65 of the second leg 52. The cross brace 60 is connected below the support brace and leg connections.

Referring again to FIG. 1, a telescopic insert 55 is disposed within each leg and extended from each leg bottom 57. A foot 54 is disposed downwardly on each telescopic insert 55.

With respect to the above description then, it is to be realized that the optimum dimensional relationships for the parts of the portable collapsible garment support rack apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the portable collapsible garment support rack apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the portable collapsible garment support rack apparatus may be used.

Therefore, the foregoing is considered as illustrative only of the principles of the portable collapsible garment support rack apparatus. Further, since numerous modifications and changes will readily occur to those skilled in the art, it is not desired to limit the portable collapsible garment support rack apparatus to the exact construction and operation shown and described, and accordingly, all suitable modifications and equivalents may be resorted to, falling within the scope of the portable collapsible garment support rack apparatus.

What is claimed is:

1. A portable collapsible garment support rack comprising, in combination:

a pair of identical upper tubes comprising a first upper tube and a second upper tube, each upper tube further comprising a horizontally disposed midline;

an expansion insert medially connecting the upper tubes;

a pair of legs disposed substantially laterally on each of the upper tubes, each pair of legs comprising a first leg and a second leg, each leg having a leg top spaced apart from a leg bottom, a flat section disposed at each leg top, the flat section of one first leg pivotally connected to a one side of the first upper tube midline, the flat section of one second leg pivotally connected to an opposite side of the midline of the first upper tube, the flat section of another first leg pivotally connected to a one side of the second upper tube midline, the flat section of the second leg pivotally connected to an opposite side of the midline of the second upper tube, the leg flat sections of the first upper tube connected by a single fastener, the leg flat sections of the second upper tube connected by a single fastener;

a pair of support braces pivotally connecting each upper tube to each of one of the pair of legs, each pair of support braces comprising a first support brace and a second support brace, one of the first support braces pivotally connected laterally to the first upper tube midline, the first support brace further pivotally connected to one first leg between the leg top and the leg bottom, one second support brace pivotally connected laterally to the first upper tube midline, the second support brace further pivotally connected to one second leg between the leg top and the leg bottom, one of the first support braces pivotally connected laterally to the second upper tube midline, the first support brace further pivotally connected to one first leg between the leg top and the leg bottom, one of the second support braces pivotally connected laterally to the second upper tube midline, the second support brace further pivotally connected to one second leg between the leg top and the leg bottom, the support braces connected to the upper tubes and the legs by fasteners;

a cross brace having a brace first end spaced apart from a brace second end, the brace first end pivotally connected to the first leg of the first upper tube by a fastener, the brace second end of the cross brace further connected to the second leg of the first upper tube by a brace notch of the cross brace removably fitted over a headed pin of the second leg, the cross brace connected below the support brace and leg connections;

a cross brace having a brace first end spaced apart from a brace second end, the brace first end pivotally connected to the first leg of the second upper tube by a fastener, the brace second end further connected to the second leg of the second upper tube by a brace notch of the cross brace removably fitted over a headed pin of the second leg, the cross brace connected below the support brace and leg connections.

2. The apparatus according to claim 1 wherein the fasteners are further removable.

3. A portable collapsible garment support rack comprising, in combination:

a pair of identical upper tubes comprising a first upper tube and a second upper tube, each upper tube further comprising a horizontally disposed midline;

an expansion insert removably, slideably and medially connecting the upper tubes;

a pair of legs disposed substantially laterally on each of the upper tubes, each pair of legs comprising a first leg and a second leg, each leg having a leg top spaced apart from a leg bottom, a flat section disposed at each leg top, the flat section of one first leg pivotally connected to a one side of the first upper tube midline, the flat section of one second leg pivotally connected to an opposite side of the midline of the first upper tube, the flat section of another first leg pivotally connected to a one side of the second upper tube midline, the flat section of the second leg pivotally connected to an opposite side of the midline of the second upper tube, the leg flat sections of the first upper tube connected by a single fastener, the leg flat sections of the second upper tube connected by a single fastener;

a pair of support braces pivotally connecting each upper tube to each of one of the pair of legs, each pair of support braces comprising a first support brace and a second support brace, one of the first support braces pivotally connected laterally to the first upper tube midline, the first support brace further pivotally connected to one first leg between the leg top and the leg bottom, one second support brace pivotally connected laterally to the first upper tube midline, the second support brace further pivotally connected to one second leg between the leg top and the leg bottom, one of the first support braces pivotally connected laterally to the second upper tube midline, the first support brace further pivotally connected to one first leg between the leg top and the leg bottom, one of the second support braces pivotally connected laterally to the second upper tube midline, the second support brace further pivotally connected to one second leg between the leg top and the leg bottom, the support braces connected to the upper tubes and the legs by fasteners;

a cross brace having a brace first end spaced apart from a brace second end, the brace first end pivotally connected to the first leg of the first upper tube by a fastener, the brace second end of the cross brace further connected to the second leg of the first upper tube by a brace notch of the cross brace removably fitted over a headed pin of the second leg, the cross brace connected below the support brace and leg connections;

a cross brace having a brace first end spaced apart from a brace second end, the brace first end pivotally connected to the first leg of the second upper tube by a fastener, the brace second end further connected to the second leg of the second upper tube by a brace notch of the cross brace removably fitted over a headed pin of the second leg, the cross brace connected below the support brace and leg connections.

4. The apparatus according to claim 3 wherein the fasteners are further removable.

5. A portable collapsible garment support rack comprising, in combination:

a pair of identical upper tubes comprising a first upper tube and a second upper tube, each upper tube further comprising a horizontally disposed midline;

an expansion insert removably, slideably and medially connecting the upper tubes;

a pair of legs disposed substantially laterally on each of the upper tubes, each pair of legs comprising a first leg and a second leg, each leg having a leg top spaced apart from a leg bottom, a flat section disposed at each leg top, the flat section of one first leg pivotally connected to a one side of the first upper tube midline, the flat section of one second leg pivotally connected to an opposite side of the midline of the first upper tube, the flat section of another first leg pivotally connected to a one side of the second upper tube midline, the flat section of the second leg pivotally connected to an opposite side of the midline of the second upper tube, the leg flat sections of the first upper tube connected by a single fastener, the leg flat sections of the second upper tube connected by a single fastener;

a telescopic insert disposed within each leg and extended from each leg bottom;

a foot disposed downwardly on each telescopic insert;

a pair of support braces pivotally connecting each upper tube to each of one of the pair of legs, each pair of support braces comprising a first support brace and a second support brace, one of the first support braces pivotally connected laterally to the first upper tube midline, the first support brace further pivotally connected to one first leg between the leg top and the leg bottom, one second support brace pivotally connected laterally to the first upper tube midline, the second support brace further pivotally connected to one second leg between the leg top and the leg bottom, one of the first support braces pivotally connected laterally to the second upper tube midline, the first support brace further pivotally connected to one first leg between the leg top and the leg bottom, one of the second support braces pivotally connected laterally to the second upper tube midline, the second support brace further pivotally connected to one second leg between the leg top and the leg bottom, the support braces connected to the upper tubes and the legs by fasteners;

a cross brace having a brace first end spaced apart from a brace second end, the brace first end pivotally connected to the first leg of the first upper tube by a fastener, the brace second end of the cross brace further connected to the second leg of the first upper tube by a brace notch of the cross brace removably fitted over a headed pin of the second leg, the cross brace connected below the support brace and leg connections;

a cross brace having a brace first end spaced apart from a brace second end, the brace first end pivotally connected to the first leg of the second upper tube by a fastener, the brace second end further connected to the second leg of the second upper tube by a brace notch of the cross brace removably fitted over a headed pin of the second leg, the cross brace connected below the support brace and leg connections.

6. The apparatus according to claim 5 wherein the fasteners are further removable.

* * * * *